US010961046B2

(12) United States Patent
Van Dinter et al.

(10) Patent No.: US 10,961,046 B2
(45) Date of Patent: Mar. 30, 2021

(54) ICE CREAM SCOOP PACKAGING APPARATUS

(71) Applicants: Randall Van Dinter, Henderson, NV (US); Charlene Van Dinter, Henderson, NV (US)

(72) Inventors: Randall Van Dinter, Henderson, NV (US); Charlene Van Dinter, Henderson, NV (US)

( * ) Notice: Subject to any disclaimer, the term of this patent is extended or adjusted under 35 U.S.C. 154(b) by 57 days.

(21) Appl. No.: 16/447,384

(22) Filed: Jun. 20, 2019

(65) Prior Publication Data

US 2020/0399053 A1 Dec. 24, 2020

(51) Int. Cl.
*B65D 85/78* (2006.01)

(52) U.S. Cl.
CPC ..... *B65D 85/78* (2013.01)

(58) Field of Classification Search
CPC ..... B65D 85/78; B65D 11/02
USPC ..... 206/464, 521.1, 564; 426/515; 220/4.24, 220/4.25
See application file for complete search history.

(56) References Cited

U.S. PATENT DOCUMENTS 239,225 A * 3/1881 Claussen
545,567 A * 9/1895 Baker
931,637 A * 8/1909 Odell
2,890,122 A 6/1959 Katon
4,244,470 A * 1/1981 Burnham ..... A23G 9/503 206/525
4,842,143 A * 6/1989 McKee, Sr. ..... B65D 85/32 206/463
5,520,939 A * 5/1996 Wells ..... B65D 75/366 426/129
5,653,345 A * 8/1997 Knoss ..... B65D 11/188 206/521.6
5,848,699 A 12/1998 Pettersson
5,976,589 A 11/1999 Desjardins
6,488,152 B1 12/2002 Steffann
6,857,277 B2 * 2/2005 Somura ..... F25C 1/18 62/74
2008/0248171 A1 10/2008 Edens
2018/0208391 A1 * 7/2018 Kim ..... A23G 3/00

* cited by examiner

*Primary Examiner* — Luan K Bui

(57) ABSTRACT

An ice cream scoop packaging apparatus for packaging individual ice cream scoops includes a bottom tray and a top tray that each has a plurality of hemispherical scoop depressions. The plurality of depressions of the bottom tray corresponds with the plurality of depressions of the top tray. A bottom lip of the bottom tray is selectively engageable with a top lip of the top tray to join the bottom tray and the top tray. The bottom scoop depressions and the top scoop extensions form a plurality of spherical scoop cavities, each configured to hold a scoop of ice cream, when the bottom tray and the top tray are joined.

7 Claims, 6 Drawing Sheets

ICE CREAM SCOOP PACKAGING APPARATUS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to ice cream packaging and more particularly pertains to a new ice cream packaging for packaging individual ice cream scoops.

BRIEF SUMMARY OF THE INVENTION

An embodiment of the disclosure meets the needs presented above by generally comprising a bottom tray that has a bottom inner side, a bottom outer side, a bottom front edge, a bottom back edge, a bottom left edge, and a bottom right edge. The bottom tray has a plurality of hemispherical bottom scoop depressions extending from the bottom inner side through the bottom outer side. A bottom lip is coupled to each of the bottom front edge, the bottom back edge, the bottom left edge, and the bottom right edge. A top tray has a top inner side, a top outer side, a top front edge, a top back edge, a top left edge, and a top right edge. The top tray has a plurality of hemispherical top scoop extensions extending from the top inner side through the top outer side. The top front edge, the top back edge, the top left edge, and the top right edge correspond with the bottom front edge, the bottom back edge, the bottom left edge, and the bottom right edge, respectively. The top scoop extensions correspond with the bottom scoop depressions. A top lip is coupled to each of the top front edge, the top back edge, the top left edge, and the top right edge. The top lip is selectively engageable with the bottom lip. The bottom scoop depressions and the top scoop extensions form a plurality of spherical scoop cavities configured to store a scoop of ice cream.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
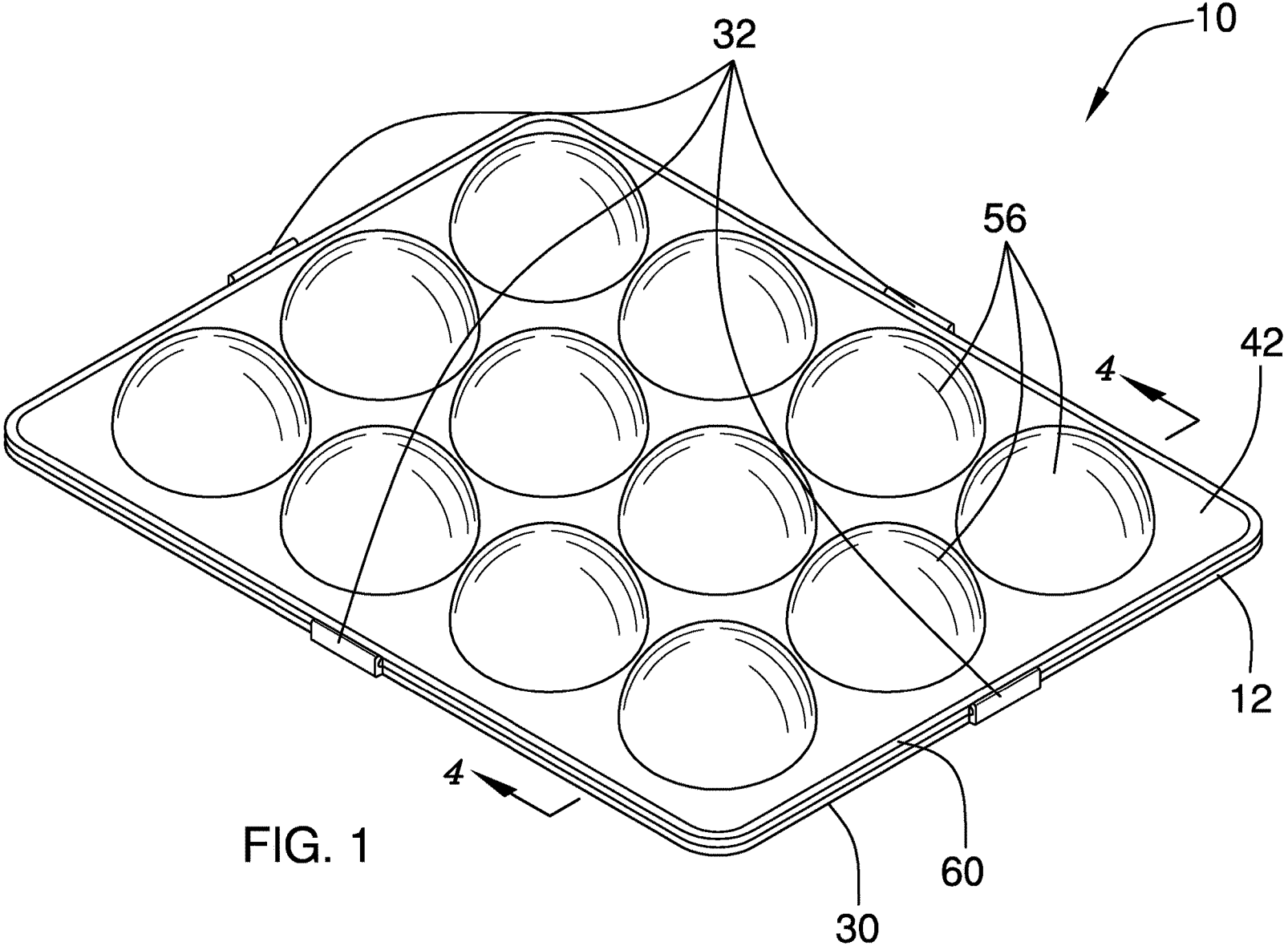
FIG. 1 is an isometric view of an ice cream scoop packaging apparatus according to an embodiment of the disclosure.
Figure 2:
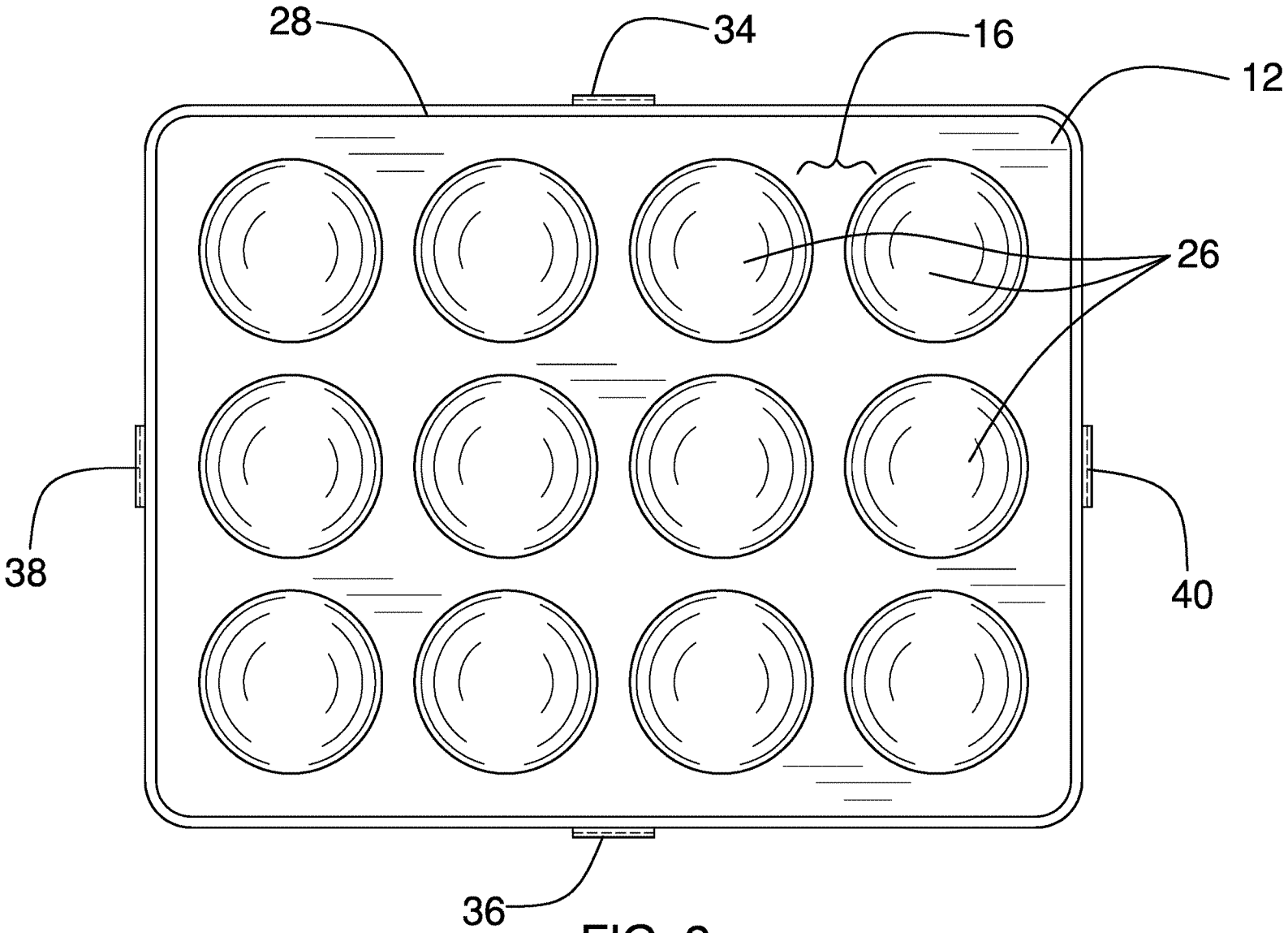
FIG. 2 is a bottom plan view of an embodiment of the disclosure.
Figure 3:
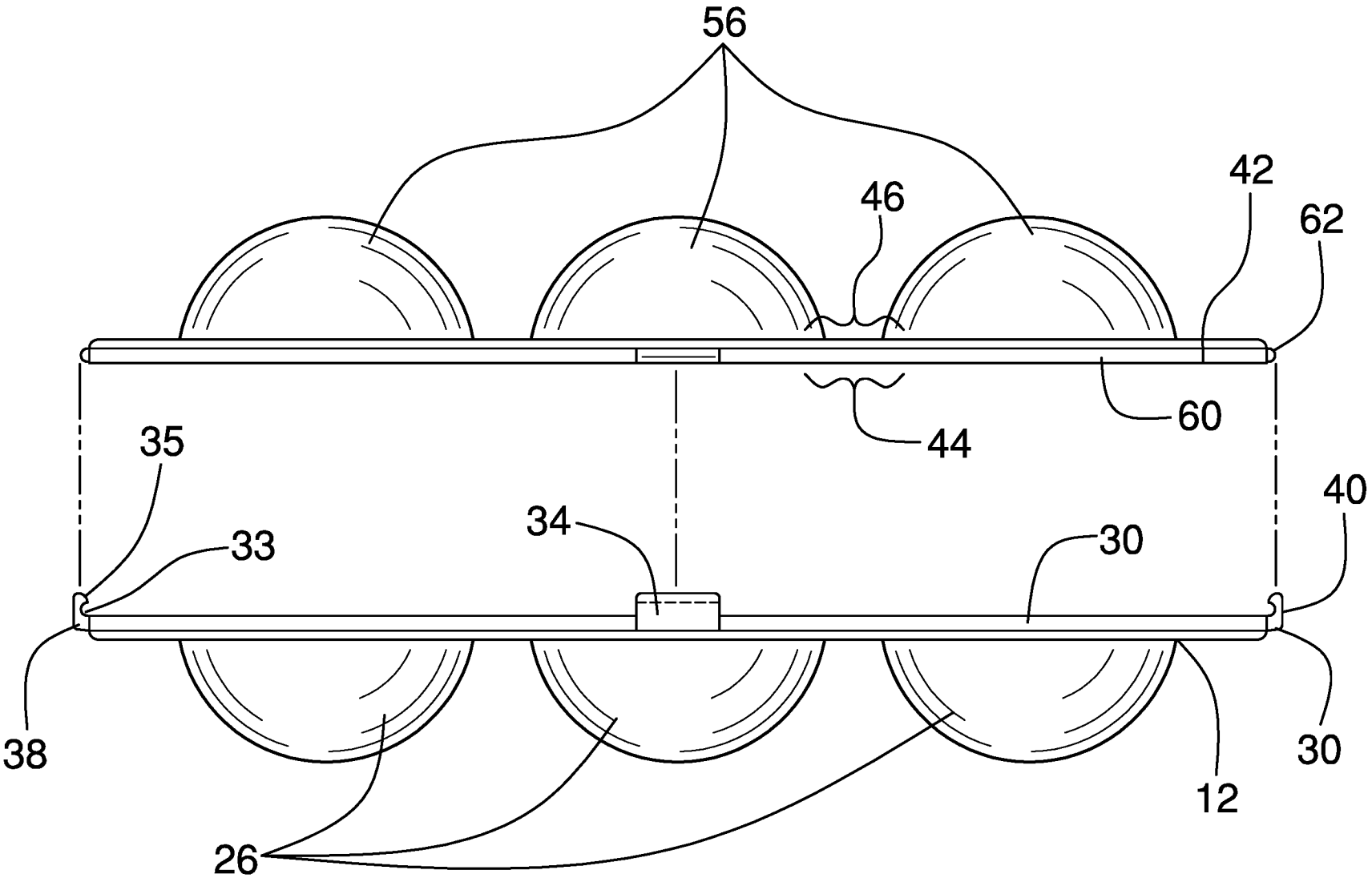
FIG. 3 is a side elevation view of an embodiment of the disclosure.
Figure 4:
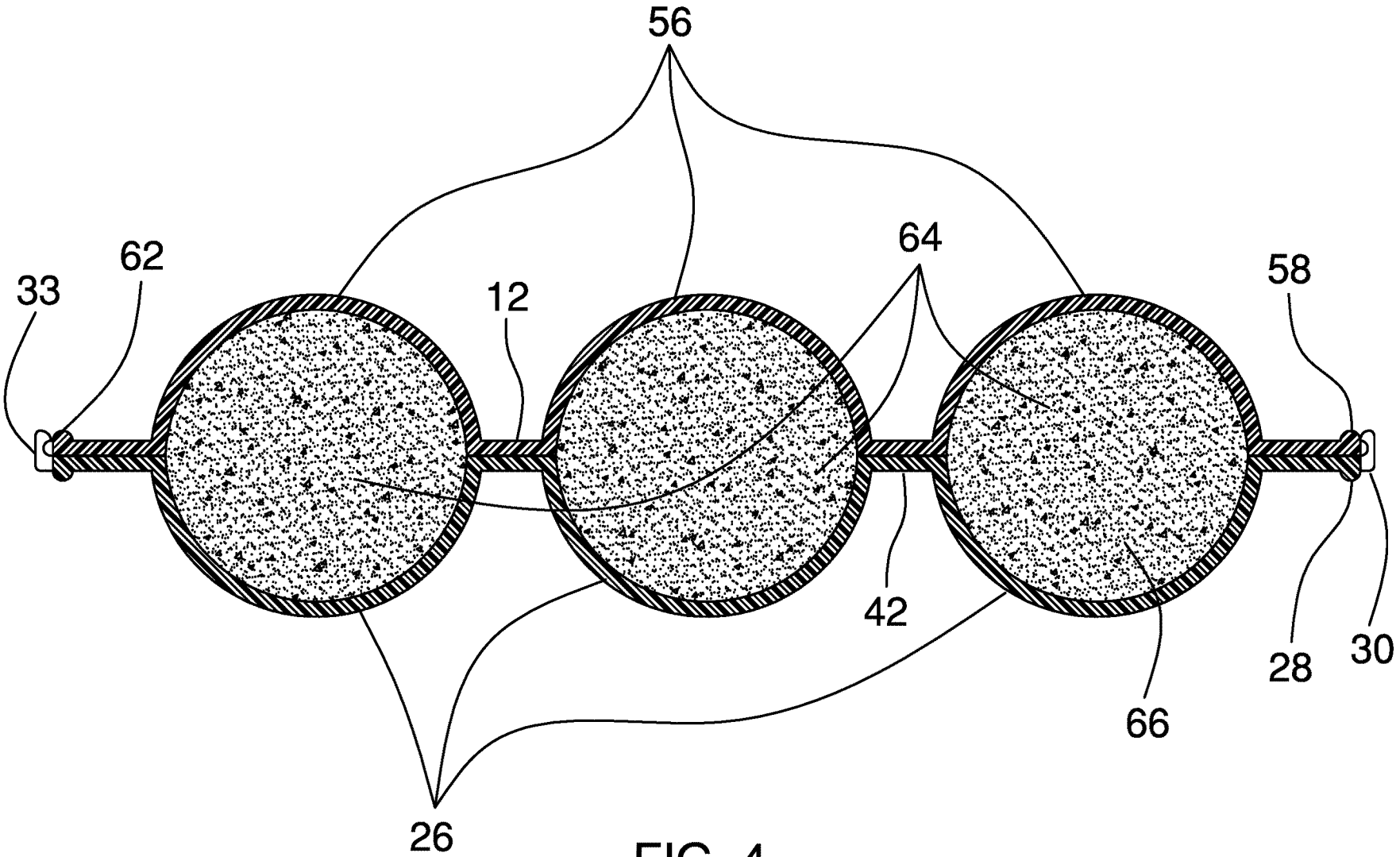
FIG. 4 is a cross-sectional view along line 4-4 of FIG. 1 of an embodiment of the disclosure.
Figure 5:
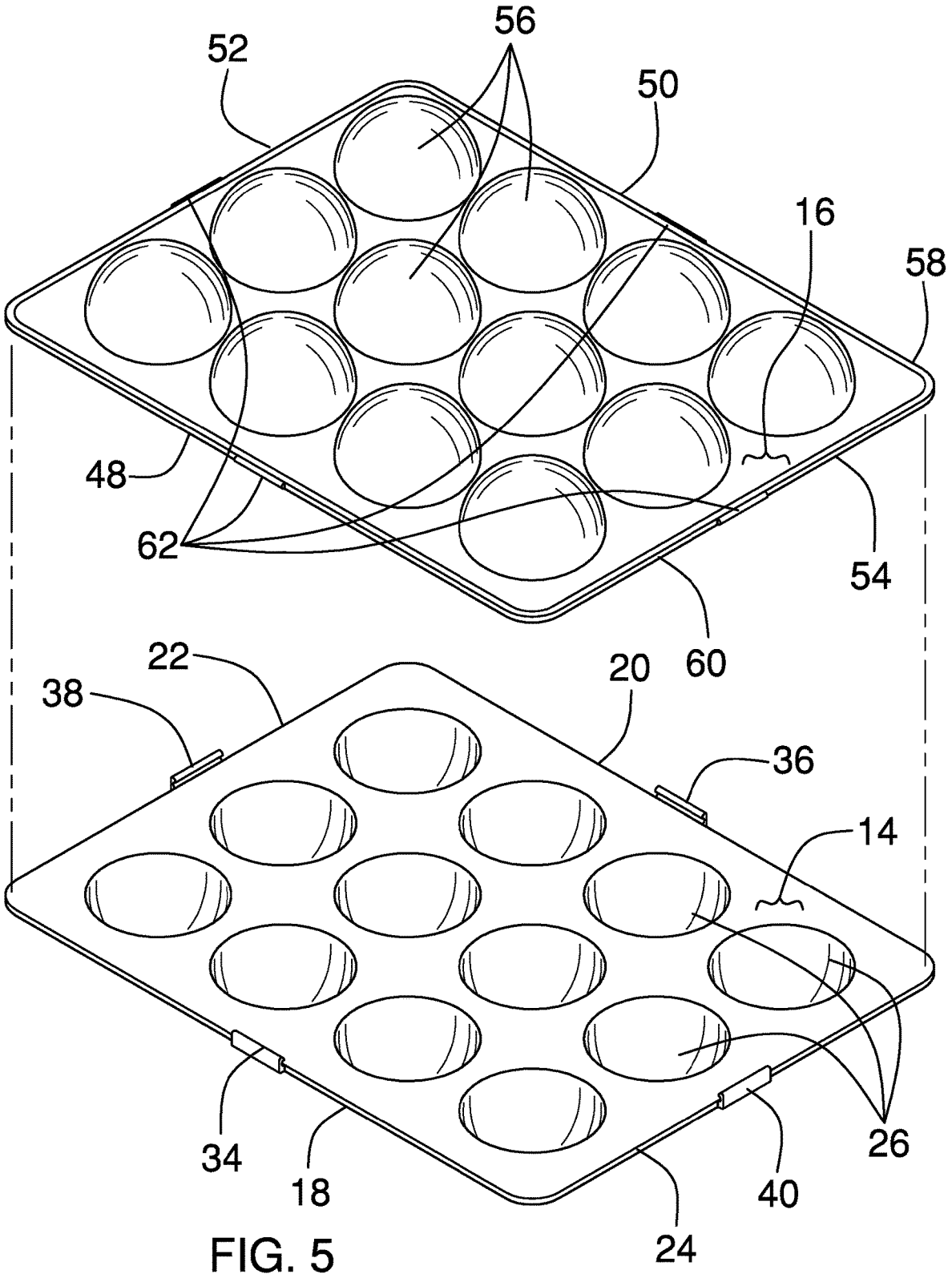
FIG. 5 is an exploded view of an embodiment of the disclosure.
Figure 6:
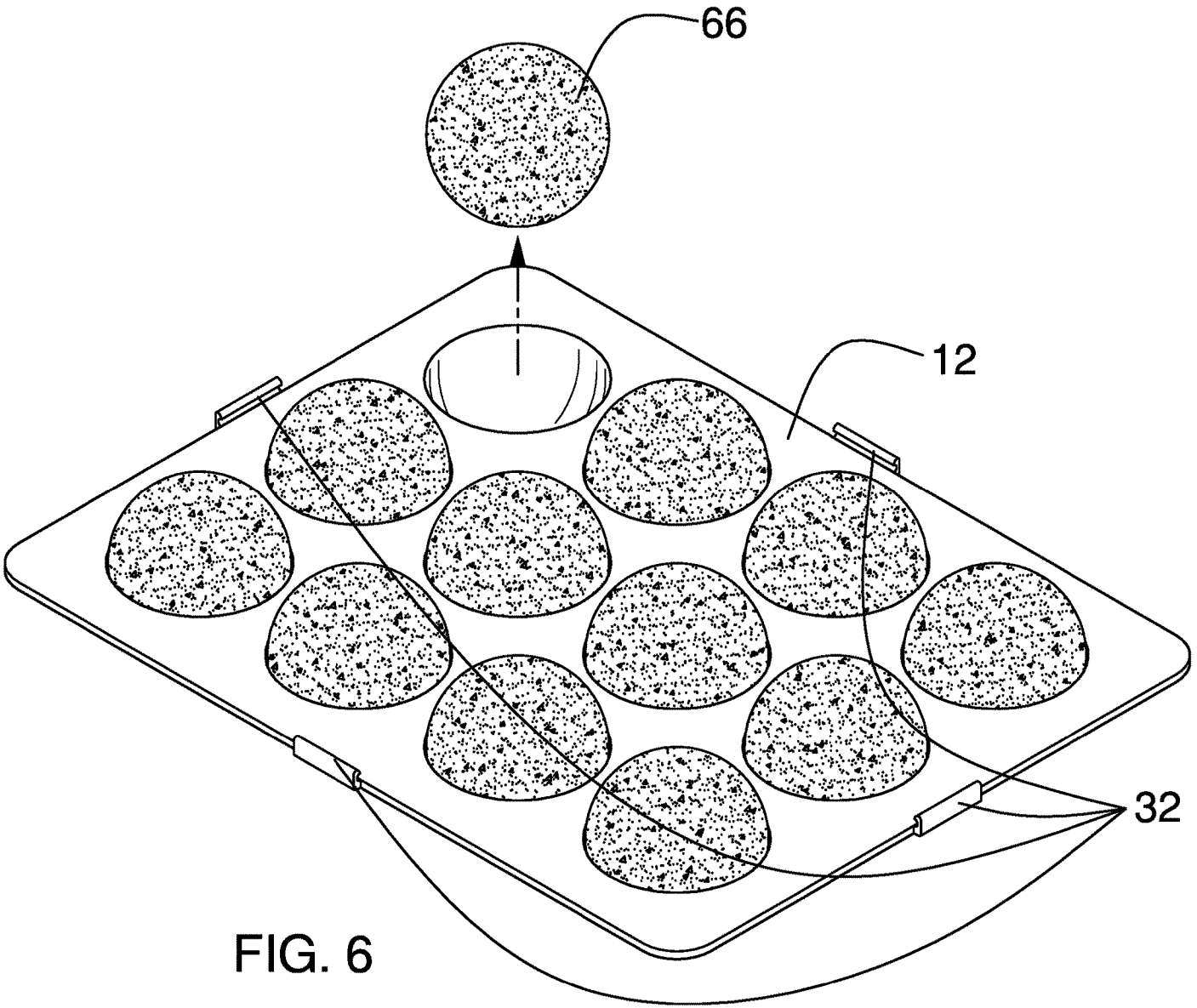
FIG. 6 is an in-use view of an embodiment of the disclosure.

With reference now to the drawings, and in particular to FIGS. 1 through 6 thereof, a new ice cream packaging embodying the principles and concepts of an embodiment of the disclosure and generally designated by the reference numeral 10 will be described.

As best illustrated in FIGS. 1 through 6, the ice cream scoop packaging apparatus 10 generally comprises a bottom tray 12 that has a bottom inner side 14, a bottom outer side 16, a bottom front edge 18, a bottom back edge 20, a bottom left edge 22, and a bottom right edge 24. The bottom tray 12 has a plurality of hemispherical bottom scoop depressions 26 extending from the bottom inner side 14 through the bottom outer side 16. The bottom scoop depressions 26 are arranged in a matrix. The bottom tray 12 may have a semicircular bottom perimeter ridge 28 continuously extending from the bottom outer side 16 adjacent the bottom front edge 18, the bottom back edge 20, the bottom left edge 22, and the bottom right edge 24. The bottom tray 12 has rounded corners. A bottom lip 30 comprises a set of four latches 32 comprising a front latch 34, a back latch 36, a left latch 38, and a right latch 40 medially coupled to the bottom front edge 18, the bottom back edge 20, the bottom left edge 22, and the bottom right edge 24, respectively. Each of the set of latches 32 extends above the bottom inner side 14 and has a semicircular groove 33 extending into an inner face 35 thereof.

A top tray 42 has a top inner side 44, a top outer side 46, a top front edge 48, a top back edge 50, a top left edge 52, and a top right edge 54. The top tray 42 has a plurality of hemispherical top scoop extensions 56 extending from the top inner side 44 through the top outer side 46, the top front edge 48, the top back edge 50, the top left edge 52, and the top right edge 54 corresponding with the bottom front edge 18, the bottom back edge 20, the bottom left edge 22, and the bottom right edge 24, respectively. The top scoop extensions 56 are arranged in a matrix corresponding with the bottom scoop depressions 26. The top tray 42 may have a semicircular top perimeter ridge 58 continuously extending from the top outer side 46 adjacent the top front edge 48, the top back edge 50, the top left edge 52, and the top right edge 54. The top tray 42 has rounded corners. The bottom perimeter ridge 28 and the top perimeter ridge 58 create a grippable place for the user to secure the apparatus 10. A top lip 60 is coupled to the top tray 42. The top lip 60 comprises a semicircular bead 62 that is selectively engageable within the groove 33 of each of the latches 32 of the bottom lip 30 to join the top tray 42 to the bottom tray 12. The bead 62 may correspond only to the latches 32 or may alternatively continuously extend around the top front edge 48, the top back edge 50, the top left edge 52, and the top right edge 54. When joined, the bottom scoop depressions 26 and the top scoop extensions 56 form a plurality of spherical scoop cavities 64 each configured to store a scoop of ice cream 66. The matrices of the bottom scoop depressions 26 and the top scoop extensions 56 may be three rows by four columns to allow the apparatus 10 to store a total of twelve scoop cavities 64. Each scoop cavity 64 is configured to hold between four and five ounces of ice cream to create a standard sized scoop of ice cream 66.

In use, scoops of ice cream 66 are placed into the bottom tray depression 26. The top tray 42 is then engaged with the bottom tray 12 to seal the ice cream scoops within the scoop cavities 64. The latches 32 are disengaged to allow the top tray 42 to be lifted to remove ice cream and are then reengaged to store the apparatus 10 again.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. An ice cream scoop packaging apparatus comprising:

a bottom tray, the bottom tray having a bottom inner side, a bottom outer side, a bottom front edge, a bottom back edge, a bottom left edge, and a bottom right edge, the bottom tray having a plurality of hemispherical bottom scoop depressions extending from the bottom inner side through the bottom outer side;

a bottom lip coupled to the bottom tray, the bottom lip being coupled to each of the bottom front edge, the bottom back edge, the bottom left edge, and the bottom right edge, the bottom lip comprising a set of four latches comprising a front latch, a back latch, a left latch, and a right latch medially coupled to the bottom front edge, the bottom back edge, the bottom left edge, and the bottom right edge, respectively, each of the set of latches extending above the bottom inner side, each of the latches having a semicircular depression extending into an inner face thereof;

a top tray, the top tray having a top inner side, a top outer side, a top front edge, a top back edge, a top left edge, and a top right edge, the top tray having a plurality of hemispherical top scoop extensions extending from the top inner side through the top outer side, the top front edge, the top back edge, the top left edge, and the top right edge corresponding with the bottom front edge, the bottom back edge, the bottom left edge, and the bottom right edge, respectively, the top scoop extensions corresponding with the bottom scoop depressions; and a top lip coupled to the top tray, the top lip being coupled to each of the top front edge, the top back edge, the top left edge, and the top right edge, the top lip being selectively engageable with the bottom lip, the bottom scoop depressions and the top scoop extensions forming a plurality of spherical scoop cavities each configured to store a respective scoop of ice cream, the top lip comprising a semicircular bead continuously extending around the top front edge, the top back edge, the top left edge, and the top right edge, the bead being selectively engageable within the depression.

2. The ice cream scoop packaging apparatus of claim 1 further comprising the bottom tray having a bottom perimeter ridge continuously extending from the bottom outer side adjacent the bottom front edge, the bottom back edge, the bottom left edge, and the bottom right edge, the top tray having a top perimeter ridge continuously extending from the top outer side adjacent the top front edge, the top back edge, the top left edge, and the top right edge.

3. The ice cream scoop packaging apparatus of claim 2 further comprising each of the bottom perimeter ridge and the top perimeter ridge having a semicircular profile.

4. The ice cream scoop packaging apparatus of claim 1 further comprising each of the bottom tray and the top tray having rounded corners.

5. The ice cream scoop packaging apparatus of claim 1 further comprising the bottom scoop depressions being arranged in a matrix and the top scoop extensions being arranged in a corresponding matrix.

6. The ice cream scoop packaging apparatus of claim 5 further comprising the matrices of the bottom scoop depressions and the top scoop extensions being three rows by four columns, the apparatus thus forming a total of twelve scoop cavities.

7. An ice cream scoop packaging apparatus comprising:

a bottom tray, the bottom tray having a bottom inner side, a bottom outer side, a bottom front edge, a bottom back edge, a bottom left edge, and a bottom right edge, the bottom tray having a plurality of hemispherical bottom scoop depressions extending from the bottom inner side through the bottom outer side, the bottom scoop depressions being arranged in a matrix, the bottom tray having a semicircular bottom perimeter ridge continuously extending from the bottom outer side adjacent the bottom front edge, the bottom back edge, the bottom left edge, and the bottom right edge, the bottom tray having rounded corners;

a bottom lip coupled to the bottom tray, the bottom lip comprising a set of four latches comprising a front latch, a back latch, a left latch, and a right latch medially coupled to the bottom front edge, the bottom back edge, the bottom left edge, and the bottom right edge, respectively, each of the set of latches extending above the bottom inner side, each of the latches having a semicircular depression extending into an inner face thereof;

a top tray, the top tray having a top inner side, a top outer side, a top front edge, a top back edge, a top left edge, and a top right edge, the top tray having a plurality of hemispherical top scoop extensions extending from the top inner side through the top outer side, the top front edge, the top back edge, the top left edge, and the top right edge corresponding with the bottom front edge, the bottom back edge, the bottom left edge, and the bottom right edge, respectively, the top scoop extensions being arranged in a matrix corresponding with the bottom scoop depressions, the top tray having a semicircular top perimeter ridge continuously extending from the top outer side adjacent the top front edge, the top back edge, the top left edge, and the top right edge, the top tray having rounded corners; and a top lip coupled to the top tray, the top lip comprising a semicircular bead continuously extending around the top front edge, the top back edge, the top left edge, and the top right edge, the bead being selectively engageable within the depression of each of the latches of the bottom lip, the bottom scoop depressions and the top scoop extensions forming a plurality of spherical scoop cavities each configured to store a respective scoop of ice cream.

* * * * *